United States Patent [19]

Yogev et al.

[11] Patent Number: 4,876,855

[45] Date of Patent: Oct. 31, 1989

[54] WORKING FLUID FOR RANKINE CYCLE POWER PLANT

[75] Inventors: Amnon Yogev, Rehovot; David Mahlab, Yavne, both of Israel

[73] Assignee: Ormat Turbines (1965) Ltd., Yavne, Israel

[21] Appl. No.: 817,130

[22] Filed: Jan. 8, 1986

[51] Int. Cl.[4] ..... F01K 25/06; F01K 25/08

[52] U.S. Cl. ..... 60/651; 60/671

[58] Field of Search ..... 60/651, 671

[56] References Cited

U.S. PATENT DOCUMENTS

| | | | |
|---|---|---|---|
| 709,115 | 9/1902 | Rosenthal | 60/671 |
| 3,282,048 | 11/1966 | Murphy et al. | 60/671 X |
| 3,841,099 | 10/1974 | Somekh | 60/671 |
| 4,084,379 | 4/1978 | Schwartzman | 60/670 X |
| 4,448,025 | 5/1984 | Oda | 60/651 |

FOREIGN PATENT DOCUMENTS 245141 3/1972 U.S.S.R. .

*Primary Examiner*—Allen M. Ostrager
*Attorney, Agent, or Firm*—Sandler & Greenblum

[57] ABSTRACT

A composite working fluid for a Rankine cycle power plant operating between a boiler temperature and a condenser temperature comprises a mixture of immiscible fluids selected such that the saturated vapor line of the composite fluid in the vicinity of the boiler temperature is generally along a line of substantially constant entropy. As a result, the vapor of the composite working fluid expands from boiler to condenser temperature generally along the saturated vapor line of the composite working fluid. One of the immiscible fluids of the composite working fluid is a "wet" fluid, and one of the immiscible fluids is a "dry" fluid. The "wet" fluid is a polar compound with a molecular weight smaller than the molecular weight of the "dry" fluid, which is a non-polar compound. Preferably, the "wet" fluid is water, and the "dry" fluid is selected from a class comprising hydrocarbons and their halogenated derivatives.

11 Claims, 1 Drawing Sheet

WORKING FLUID FOR RANKINE CYCLE POWER PLANT

TECHNICAL FIELD

This invention relates to a working fluid for a Rankine cycle power plant, and more particularly to a working fluid that is both economical and safe.

BACKGROUND OF THE INVENTION

In a Rankine cycle power plant, heat supplied to a boiler containing liquid working fluid vaporizes the working fluid at constant temperature to produce vapor that is supplied to one or more turbine stages where expansion takes place producing work. The heat depleted working fluid exhausted from the turbine stages is transferred to a condenser in which heat is extracted from the vapor condensing it to a liquid that is returned to the boiler for repeating the cycle.

When the working fluid is water, or a fluid having an almost symmetrical, bell-shaped temperature/entropy (T-S) diagram, vapor dropping from the saturated vapor state at the boiler temperature to the condenser temperature along a line of substantially constant entropy (which emulates expansion in a turbine) will result in an end state well within the liquid region of the T-S diagram. The expanded fluid will contain liquid droplets which are detrimental to efficient operation of a turbine. In other words, "wet" vapor is less efficient than dry vapor in transferring energy to a turbine stage; and, as a result, the actual thermodynamic efficiency of a power plant will not be as high as its theoretical efficiency which is directly related to the difference in temperature between the boiler and the condenser. Moreover, "wet" vapor is more corrosive to turbine components than "dry" vapor, and is thus undesirable from this standpoint alone.

The conventional solution to the problem of actual efficiency and corrosion is to stage the turbine, and to superheat the vapor so that the temperature drop in each stage is completed in the vapor region. The use of a superheater, however, reduces the actual efficiency from the theoretical efficiency, and produces a more complex and thus more expensive system.

In order to increase system efficiency, and in order to reduce system complexity, a "dry" working fluid can be used. A "dry" working fluid, such as heptane, for example, has an unsymmetrical, rightwardly skewed T-S diagram with the result that expansion of vapor along a line of substantially constant entropy takes place in the superheated region of the diagram. That is to say, the endpoint of the expansion in the turbine is in the superheated region at the pressure of the condenser, but at a temperature higher than the temperature in the condenser. Thus, the energy extracted from the working fluid will be only a portion of the available energy as determined by the temperature difference between the boiler and the condenser.

Conventionally, a regenerator is used to transfer some of the superheat to the liquid working fluid in the boiler before boiling occurs. However, this type of regenerator is inefficient because it involves a vapor/liquid heat exchanger requiring large heat transfer surfaces, thus resulting in a costly and complex system. Furthermore, with many "dry" working fluids, flammability of the vapor is a major problem. For example, heptane, and many other hydrocarbons and their halogenated derivatives, are ideally suited as working fluids in a Rankine cycle power plant because of their thermodynamic properties and their compatability with the metallic components of a power plant. However, their flammability makes their use hazardous.

It is therefore an object of the present invention to provide a new and improved working fluid for a Rankine cycle power plant which permits full expansion from the boiler to the condenser temperature at an endpoint not in the liquid region, and which reduces the fire hazard, and is thus safer, than conventional "dry" working fluids.

BRIEF DESCRIPTION OF INVENTION

According to the present invention, a composite working fluid for a Rankine cycle power plant operating between a boiler temperature and a condenser temperature comprises a mixture of immiscible fluids. The fluids are selected such that expansion of the vapor of said composite working fluid from the boiler temperature along a line of substantially constant entropy takes place generally along the saturated vapor line of the working fluid. Preferably, the vapor of the composite working fluid expands from the boiler to the condenser temperature generally along the saturated vapor line of the working fluid.

The composite working fluid is a mixture of "wet" and "dry" fluids. The "wet" fluid usually has a molecular weight smaller than the molecular weight of the "dry" fluid; and, preferably, the "wet" fluid is a polar compound selected from the class comprising water, alcohols, ammonia and amines, or mixtures thereof. The "dry" fluid is preferably non-polar and selected from the class comprising hydrocarbon and their halogenated derivatives or mixtures thereof. The mixture of "wet" and "dry" fluids causes the right-most boundary of the T-S diagram of the composite working fluid to be closer to being perpendicular to the entropy axis than the right-most boundary of the T-S diagram for either of the individual component working fluids thus achieving an improved efficiency level. Preferably the right-most boundary of the T-S diagram of the composite working fluid will be almost perpendicular to the entropy axis, thus allowing a single stage turbine to be used to expand the working fluid from the temperature of the boiler to the temperature of the condenser. This eliminates the need for superheaters or regenerators because the working vapor, both during and after expansion will not be "wet" because the vapor expands along or close to the saturated vapor line. Thus, a working fluid according to the present invention can be used in a single expansion turbine to most efficiently utilize the total available energy of the system based on the difference between the boiler and the condenser temperatures.

Because the constituents of the working fluid are immiscible, the partial pressure of each constituent in the vapor phase is dependent only on the vapor pressure of each constituent, separately, at the boiler temperature, the total pressure being the sum of the partial pressures of each constituent. Thus, the amount of each constituent in the vapor phase is independent of the amount of each constituent in the liquid phase. For this reason, a system according to the present invention will utilize a much larger quantity of "wet" fluid as compared to the amount of "dry" fluid and still be capable of producing sufficient amounts of vapor which will operate in a manner described above. For example, large quantities of water, which corresponds to a "wet" fluid and small quantities of heptane, which corresponds to a "dry" fluid, can be utilized in a system in such a way that fire hazard danger of the system is considerably reduced while still achieving high thermodynamic efficiency.

The invention is also applicable to dry fluids that are relatively expensive and are thus normally not utilized as a working fluid. For example, fluoro-hexane, which is quite expensive, can be utilized with water to achieve an efficient Rankine cycle power plant.

The two situations described above result from the immiscible nature of the two constituents of the composite working fluid. That is to say, substantially all of the liquid in the system will be contained in the boiler or evaporator and in the condenser as condensate, while all of the vapor will be contained in the turbine and the space above the liquid in both the boiler and condenser. The percentage of the "dry" fluid in the composite vapor will be considerably more than the percentage of dry fluid in the liquid. As a consequence, any fire hazard caused by the use of a flammable "dry" fluid will be minimized in the liquid state by reason of the preponderance of the "wet" liquid. This will occur without detracting from the thermodynamically efficient composite vapor produced by the mixture of immiscible fluids.

BRIEF DESCRIPTION OF THE DRAWINGS

Embodiments of the present invention are shown in the accompanying drawing herein.

DETAILED DESCRIPTION

Figure 1:
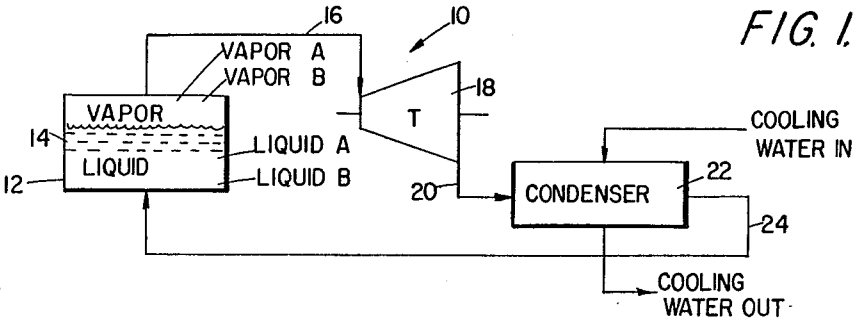
FIG. 1 is a block diagram of a Rankine cycle power plant according to the present invention.
Figures 2A, 2B, 2C:
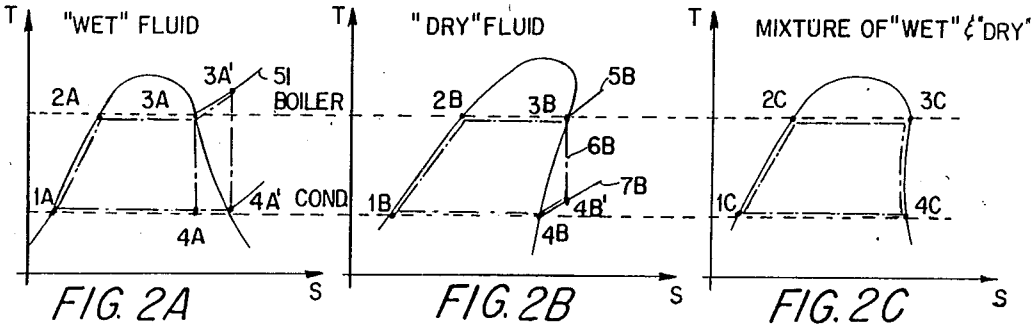
FIG. 2A is a T-S diagram of a typical "wet" working fluid, such as water.
FIG. 2B is a T-S diagram of a typical "dry" fluid, such as heptane.
FIG. 2C is a T-S diagram of a typical mixture of a "wet" fluid and "dry" fluid such as a mixture of water and heptane.

Referring now to FIG. 1, reference numeral 10 designates a Rankine cycle power plant according to the present invention utilizing a working fluid that is a mixture of two immiscible fluids, one of which is a "wet" fluid and the other of which is a "dry" fluid. The term "wet" fluid, as used in this specification, means a fluid whose T-S diagram is an essentially symmetrical, bell-shaped curve of which water is typical. Such a curve is shown in FIG. 2A. A Rankine cycle power plant operating with water, for example, operates between states 1A, 2A, 3A or 3A', and 4A or 4A'. That is to say, water in the boiler of the Rankine cycle power plant is heated from state 2 to state 3A at constant temperature and pressure until the saturated vapor line is reached; and at this point, any additional heat superheats the steam produced by the boiler and will change the state from saturated vapor to superheated steam along constant pressure line 5A to state 3A'.

If saturated vapor were supplied to a turbine stage allowing expansion to take place in the turbine, the result would be expansion along a line of substantially constant entropy to state 4A shown in FIG. 2A, at least in theory. Actually, a turbine operated under these conditions is impractical because droplets of liquid would be present in the vapor as the steam expands through the turbine stage. To achieve a practical turbine, the steam would be superheated from state 3A to state 3A' before expansion takes place. In such case, expansion would occur between state 3A' and 4A' which is the state of saturated liquid at the condenser pressure. The situation described here occurs because of the shape of the T-S diagram for a "wet" fluid. That is to say, the saturated vapor line has a negative slope in the region between boiler and condenser temperatures as indicated by the curve shown in FIG. 2A.

The term "dry" working fluid, as used in this specification, means a fluid whose T-S diagram is like that shown in FIG. 2B. When such a fluid is used in a Rankine cycle power plant, the boiler heats the liquid at constant temperature from state 2B to saturated vapor at state 3B. Further addition of heat to the saturated vapor superheats the fluid, and the state of the working fluid will lie on constant pressure line 5B at a location that depends upon the amount of heat added to the vapor.

If a "dry" working fluid were heated to produce saturated vapor at state 3B, and such vapor were applied to a turbine stage, expansion would occur essentially along the vertical line 6D (constant entropy) down to constant pressure line 7B which is determined by the pressure in the condenser. The vapor at state 4B' still is superheated; and in order to be returned to the boiler, the superheat must be removed. It can be rejected into the condenser coolant, or it can be used to preheat the condensate feed to the boiler. In either case, it is apparent that the energy extracted from a turbine based on the cycle shown in FIG. 2B will be less than the theoretical maximum possible because the temperature difference between state 3B and 4B' is less than the temperature difference between state 3B and 4A which is the temperature of the condenser.

FIG. 2C represents the T-S diagram for a mixture of a "wet" working fluid with an immiscible "dry" working fluid. For given evaporation and condensing temperatures, the "dry" and "wet" fluids are chosen so as to produce a saturated vapor line that is almost perpendicular to the entropy axis. An example of a "wet" fluid is water: and an example of a "dry" fluid is heptane. As illustrated in FIG. 2C, the liquid constituents of the working fluid are heated from state 2C to state 3C at constant temperature producing vapor of each constituent. Because the constituents of the working fluid are immiscible in the liquid state, the amount of each constituent in the vapor phase is independent of the amount of each constituent in the liquid phase within the boiler. This means that the percentage of constituents in the composite vapor is very different from the percentage in the composite liquid. From a practical standpoint, this means that the thermodynamic properties of the composite vapor can be made to closely resemble the properties of the "dry" fluid, while the composite liquid will closely resemble the "wet" fluid.

Expansion occurs from state 3C to state 4C essentially along the saturated vapor line of the composite so that the temperature drop available for conversion into energy is the same as the temperature difference between the boiler and the condenser. Thus, a working fluid that is a mixture of a "wet" and a "dry" fluid having a resultant T-S diagram like that shown in FIG. 2C, will enable a Rankine cycle power plant to operate at maximum thermodynamic efficiency relative to the theoretical thermodynamic efficiency of the cycle which is determined by the temperature difference between the boiler and the condenser.

Returning now to FIG. 1, power plant 10 includes boiler 12 containing a mixture of two immiscible liquids designated as "A" and "B", to which heat is applied by a source (not shown). The heat applied to liquid 14 in boiler 12 vaporizes the composite liquid producing a composite vapor; and conduit 16 conveys the composite vapor to the inlet of turbine 18 where expansion takes place producing heat depleted vapor in exhaust conduit 20. The heat depleted composite vapor is transferred via conduit 20 to condenser 22, which may be either air cooled to liquid cooled, wherein the heat depleted vapor is condensed to produce condensate that is returned by a pump (not shown), or by gravity, to boiler 12 via conduit 24.

The present invention is particularly suitable when the working fluid includes a liquid that is flammable such as a hydrocarbon or its partially halogenated derivatives. An example of a flammable fluid that is suitable for a working fluid in a Rankine cycle power plant is heptane. By adding water to the system, the efficiency of the system is increased, and the hazard associated with using a flammable fluid is reduced. The increase in efficiency results from mixing the "dry" working fluid, such as heptane with a "wet" working fluid, such as water, resulting in a mixture whose T-S diagram is of the type shown in FIG. 2C. The fire hazard is reduced because the boiler contains essentially water while only the vapor contains a significant amount of heptane. For example, in a typical organic fluid power plant capable of producing 500 KW, about 4,000 Kg of heptane would be required were heptane alone used in the system. When mixed with water, only about 100 Kg of heptane is needed.

When the desired working fluid is expensive, adding water to the system will increase efficiency and reduce costs. As described above, an increase in efficiency arises because of the restructuring of the T-S diagram of the resultant mixture; and a reduction in cost arises because only a relatively small amount of expensive fluid is required. For example, prefluoro-hexane is a fluid that is thermodynamically efficient and is compatible with the metallic components of a power plant. However, the current price for this fluid is about $30.00 per Kg making the use of this fluid, by itself, in a power plant cost prohibitive. However, by adding water to the perfluoro-hexane, the amount of perfluoro-hexane needed is reduced by a factor of about 100 or more. Therefore, construction of a power plant utilizing fluoro-hexane as the working fluid becomes practical.

Generally speaking, "wet" fluids are polar, and have a relatively low molecular weight. Examples are water, the alcohols, ammonia, amines, etc. These fluids are considered as being non-hazardous with respect to fire. "Dry" fluids, on the other hand, are non-polar, and have a relatively high molecular weight. Examples are hydrocarbons, and their halogenated derivatives (e.g. esters).

EXAMPLE I

A Rankine cycle power plant based on a composite fluid comprising a mixture of heptane and water may be designed for a turbine inlet of 200° C. and a condenser temperature of 40° C. Under these constraints, a mixture of water and heptane will produce a vapor whose composition is 78% heptane by weight and 22% water by weight. Conditions in the power plant would be as follows:

| Parameter | Value |
|---|---|
| Boiler Pressure (Bar) | 25.4 |
| Vapor Density (KG/M$^3$) | 41.8 |
| Condenser Pressure (Bar) | 0.19 |
| Vapor Density (Kg/m$^3$) | 0.52 |
| Turbine Isentropic Exit Temperature (°C.) | 40 |
| Percent of wet water | 4.2 |
| Heat Input (Kj/Kg) | 1105 |
| Energy of Isentropic Expansion (Kj/Kg) | 305 |
| Net Efficiency (percent) | 17.9 |

EXAMPLE II

A Rankine cycle power plant based on a composite working fluid comprising a a mixture of 1—1 dimethyl cyclohexane (DMCH) and water may be designed for a turbine inlet temperature of 300° C. and a condenser temperature of 40° C. Under these constraints, a mixture of these constituents would produce a vapor whose composition is 43% DMCH by weight and 57% water by weight. Conditions in the power plant would be as follows:

| Parameter | Value |
|---|---|
| Boiler Pressure (Bar) | 110 |
| Vapor Density (Kg/m$^3$) | 158 |
| Condenser Pressure (Bar) | 0.14 |
| Vapor Density (Kg/m$^3$) | 0.33 |
| Turbine Isentropic Exit Temperature (°C.) | 40 |
| Percent wet DMCH | 0.00 |
| Percent of wet water | 6.0 |
| Heat Input (Kj/Kg) | 1460 |
| Energy of Isentropic Expansion (Kj/Kg) | 519 |
| Net Efficiency (percent) | 22.3 |

EXAMPLE III

A Rankine cycle power plant based on a composite working fluid comprising a mixture of undecane and ethylene glycol (EG) may be designed for a turbine inlet temperature of 300° C., and a condenser temperature of 40° C. Under these constraints, a mixture of these constituents would produce a vapor that is 50% undecane and 50% EG. Conditions in the power plant would be as follows:

| Parameter | Value |
|---|---|
| Boiler Pressure (Bar) | 26.3 |
| Vapor Density (Kg/m$^3$) | 65 |
| Condenser Pressure (Bar) | 0.002 |
| Vapor Density (Kg/m$^3$) | 0.011 |
| Turbine Isentropic Exit Temperature (°C.) | 56 |
| Heat Input (Kj/Kg) | 1372 |
| Energy of Isentropic Expansion (Kj/Kg) | 469 |
| Net Efficiency (percent) | 22.3 |

Although the invention has been described with reference to particular means, materials and embodiments, it is to be understood that the invention is not limited to the particulars disclosed, and extends to all equivalents within the scope of the claims.

What is claimed is:

1. A method for increasing the thermodynamic efficiency of a Rankine cycle power plant of the type that employs an organic working fluid, such as a hydrocarbon or a halogenated derivative thereof, and that has a boiler for vaporizing the working fluid, a turbine responsive to vaporized working fluid produced by the boiler and producing power and heat depleted working fluid, and a condenser for condensing the heat depleted working fluid and producing condensate that is returned to the boiler, said method comprising the step of adding water to the organic fluid such that most of the liquid in the boiler is water and most of the vapor in the turbine is the vaporized organic fluid.

2. A method according to claim 1 wherein said organic working fluid is heptane.

3. A method according to claim 1 wherein said organic working fluid is perfluoro-hexane.

4. A method according to claim 1 wherein said organic working fluid is 1—1 dimethyl cyclohexane.

5. A method according to claim 1 wherein said organic working fluid is undecane.

6. A Rankine cycle power plant comprising:

(a) a composite working fluid;

(b) a boiler containing said working fluid for vaporizing the same and producing vaporized working fluid;

(c) a turbine responsive to said vaporized working fluid for producing power and heat depleted working fluid;

(d) a condenser for condensing the heat depleted working fluid and producing condensate;

(e) means for effecting the return of said condensate to said boiler; and (f) said composite working fluid comprising an organic fluid such as a hydrocarbon or a halogenated derivative thereof, and a "wet" fluid, said composite working fluid being characterized in that most of the liquid in the boiler is the "wet" fluid, and most of the vapor in the turbine is vaporized organic fluid.

7. A Rankine cycle power plant according to claim 6 wherein said "wet" fluid is selected from the group consisting of water, alcohols, and ammonia amines.

8. A Rankine cycle power plant according to claim 6 wherein said organic fluid is heptane.

9. A Rankine cycle power plant according to claim 6 wherein said organic fluid is perfluoro-hexane.

10. A Rankine cycle power plant according to claim 6 wherein said organic fluid is 1—1 dimethyl cyclohexane.

11. A Rankine cycle power plant according to claim 6 wherein said organic fluid is undecane.

* * * * *